US008953818B2

(12) United States Patent
Elmedyb et al.

(10) Patent No.: US 8,953,818 B2
(45) Date of Patent: Feb. 10, 2015

(54) SPECTRAL BAND SUBSTITUTION TO AVOID HOWLS AND SUB-OSCILLATION

(75) Inventors: Thomas Bo Elmedyb, Smørum (DK); Jesper Jensen, Smørum (DK)

(73) Assignee: Oticon A/S, Smorum (DK)

( * ) Notice: Subject to any disclaimer, the term of this patent is extended or adjusted under 35 U.S.C. 154(b) by 529 days.

(21) Appl. No.: 13/146,849

(22) PCT Filed: Feb. 6, 2009
(86) PCT No.: PCT/EP2009/051361
§ 371 (c)(1),
(2), (4) Date: Aug. 17, 2011

(87) PCT Pub. No.: WO2010/088960
PCT Pub. Date: Aug. 12, 2010

(65) Prior Publication Data

US 2011/0311075 A1 Dec. 22, 2011

(51) Int. Cl.
*G10L 21/0208* (2013.01)
*H04R 3/02* (2006.01)
*H04R 25/00* (2006.01)

(52) U.S. Cl.
CPC ..... *H04R 25/453* (2013.01); *H04R 3/02* (2013.01); *H04R 25/353* (2013.01); *H04R 2430/03* (2013.01)
USPC ..... 381/94.2; 381/94.1; 381/94.3; 381/83; 381/93; 381/95; 381/96; 381/318

(58) Field of Classification Search
USPC ..... 381/94.1–94.3, 83, 93, 95, 96, 318
See application file for complete search history.

(56) References Cited

U.S. PATENT DOCUMENTS 5,784,300 A * 7/1998 Neumeier et al. ..... 702/106
6,898,293 B2 5/2005 Kaulberg (Continued)

FOREIGN PATENT DOCUMENTS

EP 1 367 566 A2 12/2003
EP 1 480 494 A2 11/2004

(Continued)

OTHER PUBLICATIONS

Hastl et al., "Psychoacoustics, Facts and Models", 3rd edition, Springer, IBN 10 3-540-23159-5, Chapter 4, pp. 61-110 and Chapter 7.5, pp. 194-202 (2007).

(Continued)

*Primary Examiner* — Duc Nguyen
*Assistant Examiner* — George Monikang
(74) *Attorney, Agent, or Firm* — Birch, Stewart, Kolasch & Birch, LLP

(57) ABSTRACT

A listening device for processing an input sound to an output sound, includes an input transducer for converting an input sound to an electric input signal, an output transducer for converting a processed electric output signal to an output sound, a forward path being defined between the input transducer and the output transducer and including a signal processing unit for processing an input signal in a number of frequency bands and an SBS unit for performing spectral band substitution from one frequency band to another and providing an SBS-processed output signal, and an LG-estimator unit for estimating loop gain in each frequency band thereby identifying plus-bands having an estimated loop gain according to a plus-criterion and minus-bands having an estimated loop gain according to a minus-criterion. Based on an input from the LG-estimator unit, the SBS unit is adapted for substituting spectral content in a receiver band of the input signal with spectral content from a donor band in such a way that spectral content of the donor band is copied and possibly scaled with a scaling function and inserted in the receiver band instead of its original spectral content, wherein the receiver band is a plus-band and the donor band is a minus-band.

27 Claims, 6 Drawing Sheets

(56) References Cited

U.S. PATENT DOCUMENTS

| | | | | |
|---|---|---|---|---|
| 7,092,532 | B2 | 8/2006 | Luo et al. | |
| 7,133,529 | B2 | 11/2006 | Ura | |
| 2001/0002930 | A1* | 6/2001 | Kates | 381/317 |
| 2002/0041208 | A1* | 4/2002 | Hamada et al. | 330/149 |
| 2007/0076910 | A1 | 4/2007 | Sporer | |
| 2007/0223752 | A1* | 9/2007 | Boretzki et al. | 381/312 |
| 2007/0269068 | A1 | 11/2007 | Komagel et al. | |
| 2008/0273728 | A1 | 11/2008 | Klinkby et al. | |
| 2009/0185704 | A1* | 7/2009 | Hockley | 381/316 |

FOREIGN PATENT DOCUMENTS

| | | | |
|---|---|---|---|
| EP | 1 675 374 | A1 | 6/2006 |
| WO | WO 94/09604 | A1 | 4/1994 |
| WO | WO 2004/105430 | A1 | 12/2004 |
| WO | WO 2007/006658 | A1 | 1/2007 |
| WO | WO 2007/112777 | A1 | 10/2007 |
| WO | WO 2008/151970 | A1 | 12/2008 |

OTHER PUBLICATIONS

Hellgren, "Compensation for hearing loss and cancellation of acoustic feedback in digital hearing aids", Linkoping Studies in Science and Technology, Dissertations, No. 628, Linkoping University Medical Dissertations, Sweden, (2000).

van de Par et al., "A new perceptual model for audio coding based on spectro-temporal masking", Proceedings of the Audio Engineering Society 124th Convention, Amsterdam, The Netherlands, pp. 243-256 (2008).

* cited by examiner

SPECTRAL BAND SUBSTITUTION TO AVOID HOWLS AND SUB-OSCILLATION

TECHNICAL FIELD

The present invention relates in general to howl suppression in listening devices, and in particular in such devices, where a receiver is positioned relatively close to a microphone with an electric signal path between them. The invention relates specifically to a listening device for processing an input sound to an output sound, to a method of minimizing howl in a listening device and to the use of a listening device. The invention further relates to a data processing system and to a computer readable medium.

The invention may e.g. be useful in applications such as portable communication devices prone to acoustic feedback problems, e.g. in the ear (ITE) type hearing instruments.

BACKGROUND ART

The following account of the prior art relates to one of the areas of application of the present invention, hearing aids.

In hearing aids, acoustic feedback from the receiver to the microphone(s) may lead to howl. In principle, howls occur at a particular frequency if two conditions are satisfied:

a) The loop gain exceeds 0 dB.

b) The external signal and feedback signal are in-phase when picked up by the microphone.

WO 2007/006658 A1 describes a system and method for synthesizing an audio input signal of a hearing device. The system comprises a filter unit for removing a selected frequency band, a synthesizer unit for synthesizing the selected frequency band based on the filtered signal thereby generating a synthesized signal, a combiner unit for combining the filtered signal and the synthesized signal to generate a combined signal.

US 2007/0269068 A1 deals with feedback whistle suppression. A frequency range which is susceptible to feedback is determined. From an input signal which has a spectral component in the frequency range susceptible to feedback, a predeterminable component is substituted with a synthetic signal.

WO 2008/151970 A1 describes a hearing aid system comprising an online feedback manager unit for—with a predefined update frequency—identifying current feedback gain in each frequency band of the feedback path, and for subsequently adapting the maximum forward gain values in each of the frequency bands in dependence thereof in accordance with a predefined scheme.

WO 2007/112777, and WO 94/09604 describe various estimators of loop gain as a function of frequency.

DISCLOSURE OF INVENTION

In principle, a howl under build-up can be avoided, if it is ensured that conditions a) and b) are not satisfied for longer durations of time for a particular frequency or frequency range.

To achieve this, we propose criteria based on loop gain estimates to identify sub bands for which condition a) and b) or only a) holds, and then substitute the spectral content in these sub bands with scaled spectral content e.g. from neighbouring sub bands for which the chosen criterion based on loop gain estimate is NOT fulfilled; in this way, the feedback loop has been broken and a howl build-up is not possible. We propose a set-up where the frequency axis is divided into K non-overlapping (ideally narrow) sub-bands, as indicated in FIG. 1. In this figure, two sub bands have been identified to fulfil the chosen criterion (indicated by '+'), while for the other sub bands the chosen criterion is NOT fulfilled (indicated by '−').

An object of the present invention is to minimize or avoid build-up of howl in a listening device.

Objects of the invention are achieved by the invention described in the accompanying claims and as described in the following.

An object of the invention is achieved by a listening device for processing an input sound to an output sound (e.g. according to a user's needs). The listening device comprises

- an input transducer for converting an input sound to an electric input signal and
- an output transducer for converting a processed electric output signal to an output sound,
- a forward path being defined between the input transducer and the output transducer and comprising
  - a signal processing unit for processing an input signal in a number of frequency bands, and
  - an SBS unit for performing spectral band substitution from one frequency band to another and providing an SBS-processed output signal, and
- an LG-estimator unit for estimating loop gain in each frequency band thereby identifying plus-bands having an estimated loop gain according to a plus-criterion and minus-bands having an estimated loop gain according to a minus-criterion, wherein—based on an input from the LG-estimator unit—the SBS unit is adapted for substituting spectral content in a receiver band of the input signal with spectral content from a donor band in such a way that spectral content of the donor band is copied and possibly scaled with a scaling function and inserted in the receiver band instead of its original spectral content, wherein the receiver band is a plus-band and the donor band is a minus-band.

This has the advantage of providing an alternative scheme for suppressing howl.

Conditions a) AND b) state that an oscillation due to acoustical feedback (typically from an external leakage path) and/or mechanical vibrations in the hearing aid can occur at any frequency having a loop gain larger than 1 (or 0 dB in a logarithmic expression) AND at which the phase shift around the loop is an integer multiple of 360°. A schematic illustration of a listening system is shown in FIG. 4*a*, and its mathematical model is shown in FIG. 4*b*. This leads (in a linear representation) to an expression for the closed loop transfer function $H_{cl}(f)=FG(f)/(1-LG(f))$, where the FG and LG (and thus $H_{cl}$) are complex valued functions of frequency (and time), cf. e.g. [Hellgren, 2000]. FG is the forward gain of the forward path of the listening device and LG is the open loop gain defined as the forward gain FG times the feedback gain FBG of the listening device, cf. FIG. 4*b*. A general criterion for an instability of the circuit (due to feedback) is thus that LG is close to the real number 1 (i.e. that the imaginary part of LG is relatively close to 0 and the real part of LG is relatively close to +1).

In a logarithmic representation, the frequency dependent loop gain LG is the sum (in dB) of the (forward) gain FG in the forward path (e.g. fully or partially implemented by a signal processor (SP)) and the gain FBG in the acoustical feedback path between the receiver and the microphone of the hearing aid system (e.g. estimated by an adaptive filter). Thus, $LG(f)=FG(f)+FBG(f)$, where f is the frequency. In practice, the frequency range $\Delta f=[f_{min}; f_{max}]$ considered by the hearing aid system is limited to a part of the typical human audible frequency range 20 Hz≤f≤20 kHz (where typically the upper frequency limit $f_{max}$ may differ in different types of hearing aids) and may be divided into a number K of frequency bands (FB), e.g. K=16, ($FB_1$, $FB_2$, . . . , $FB_K$). In that case, the expression for the loop gain can be expressed in dependence of the frequency bands, i.e. $LG(FB_i)=FG(FB_i)+FBG(FB_i)$, i=1, 2, . . . , K, or simply $LG_i=FG_i+FBG_i$. In general, gain parameters LG, FG and FBG are frequency (and time) dependent within a band. Any value of a gain parameter of a band can in principle be used to represent the parameter in that band, e.g. an average value. It is intended that the above expression for loop gain ($LG(FB_i)$, $LG_i$) in a given frequency band i ($FB_i$) is based on the values of the parameters $FG_i(f)$, $FBG_i(f)$ in band i leading to the maximum loop gain (i.e. if loop gain is calculated for all frequencies in a given band, the maximum value of loop gain is used as representative for the band).

Similarly, if the closed loop transfer function $H_{cl}(FB_i)$ in a particular frequency band $FB_i$ is considered, the value leading to a maximum magnitude of the transfer function (in a linear representation) $H_{cl}(f)=FG(f)/(1-LG(f))$ in that band is chosen. In a given frequency band k, values of current loop gain, $LG(t_p)$, and current feedback gain, $FBG(t_p)$ at the given time $t_p$ are termed $LG_k(t_p)$ and $FBG_k(t_p)$, respectively. Similarly for current values of forward gain FG and closed loop transfer function $H_{cl}$. In an embodiment, the Loop Gain Estimator is adapted to base its estimate of loop gain in a given frequency band on an estimate of the feedback gain and a current request for forward gain according to a user's needs (possibly adapted dependent upon the current input signal, its level, ambient noise, etc.) in that frequency band.

The term 'spectral content of a band' is in the present context taken to mean the (generally complex-valued) frequency components of a signal in the band in question (cf. e.g. FIG. 1*b*). In general the spectral content at a given frequency comprises corresponding values of the magnitude and phase of the signal at that frequency at a given time (as e.g. determined by a time to frequency transformation of a time varying input signal at a given time or rather for a given time increment at that given time). In an embodiment, only the magnitude values of the signal are considered. In general, a particular frequency band may contain signal values at any number of frequencies. The number of frequency values of a band may be the same for all bands or different from one band to another. The division of the signal in frequency bands may be different in different parts of the listening system, e.g. in the signal processing unit and the loop gain estimator.

In a particular embodiment, the SBS unit is adapted to select the donor band to provide minimum distortion.

The term 'distortion' is in the present context taken to mean the distortion perceived by a human listener; in the present context, this distortion is estimated using a model of the (possibly impaired) human auditory system.

In a particular embodiment, the SBS unit is adapted to select the donor band based on a model of the human auditory system.

In an embodiment, the selection of a donor band is e.g. based on a predefined algorithm comprising a distortion measure indicating the experienced distortion by moving spectral content from a particular donor band to a particular receiver band.

In an embodiment, the donor band is selected among bands comprising lower frequencies than those of the receiver band.

In a particular embodiment, the model of the human auditory system used for the selection of a donor band is customized to a specific intended user of the listening device.

Psycho-acoustic models of the human auditory system are e.g. discussed in [Hastl et al., 2007], cf. e.g. chapter 4 on 'Masking', pages 61-110, and chapter 7.5 on 'Models for Just-Noticeable Variations', pages 194-202. A specific example of a psycho-acoustic model is provided in [Van de Par et al., 2008].

In an embodiment, the listening device is adapted to at least include parts of a model of the human auditory system relevant for estimating distortion by substituting spectral content from a donor band i to a receiver band j. This feature is particularly relevant in a system, which adapts the gain and/or distortion measures over time.

In a particular embodiment, the SBS unit is adapted to select the donor band from the input signal from a second input transducer, e.g. from a contra-lateral listening device or from a separate portable communication device, e.g. a wireless microphone or a mobile telephone or an audio gateway. This has the advantage of providing a donor band which is at least less susceptible to acoustic feedback from a receiver of the (first) listening device containing the first input transducer. In an embodiment, the selected donor band comprises the same frequencies as the receiver band. In an embodiment, the donor band is selected from another part of the frequency range than the receiver band.

In a particular embodiment, the spectral content of the receiver band (after substitution) is equal to the spectral content of the donor band times a (generally complex-valued) scaling factor. Preferably, the scaling factor is adapted to provide that the magnitude of the signal (such as the average magnitude, if the band comprises more than one frequency) in the receiver band after substitution is substantially equal to the magnitude (e.g. the average magnitude) of the signal in the receiver band before substitution. In an embodiment, the scaling function is a constant factor. In an embodiment, the factor is equal to 1. Alternatively the scaling may be represented by a frequency dependent gain function.

In a particular embodiment, the listening device comprises a memory wherein predefined scaling factors (gain values) $G_{ij}$ for scaling spectral content from donor band i to receiver band j are stored. Preferably, the scaling factors $G_{ij}$ are constants (for a given i,j).

In a particular embodiment, the listening device comprises a memory wherein predefined distortion factors $D_{ij}$ defining the expected distortion when substituting spectral content from donor band i to a receiver band j are stored. Preferably, the distortion factors $D_{ij}$ are constants.

In an embodiment, gain values $G_{ij}$ and/or distortion factors $D_{ij}$ are determined for a number of sets of audio ('training') data of different type. In a particular embodiment, gain values $G_{ij}$ and/or distortion factors $D_{ij}$ for each type of audio data are separately stored. In a particular embodiment, the gain values $G_{ij}$ and/or the distortion factors $D_{ij}$ are determined as average values of a number of sets of 'training data'. In an embodiment, sets of training data expected to be representative of the signals to which the user of the listening device will be exposed are used. In a particular embodiment, the gain values $G_{ij}$ and or the distortion factors $D_{ij}$ are determined in an off-line procedure and stored in the listening device (e.g. prior to the use of the listening device, or during a later procedure). In an embodiment, the listening device is adapted to analyse an input signal and determine its type, and to select an appropriate one of the gain $G_{ij}$- and/or distortion $D_{ij}$-factors to be used in the spectral substitution process.

In a particular embodiment, the listening device is adapted to update the stored predefined scaling factors $G_{ij}$ and/or distortion factors $D_{ij}$ over time. In an embodiment, an update of the stored scaling factors $G_{ij}$ and/or distortion factors $D_{ij}$ over time is/are based on the signals to which the listening device is actually exposed. In an embodiment, the scaling factors and/or the distortion factors are updated as a running average of previous values, so that predefined values are overridden after a certain time (e.g. as in a first-in, first-out buffer of a predefined size). In an embodiment, the factors are updated with a certain update frequency, e.g. once an hour or once a day or once a week. Alternatively, the listening device is adapted to allow an update of the scaling and/or distortion factors to be user initiated. Alternatively or additionally, the listening device comprises a programming interface, and is adapted to allow an update of the scaling and/or distortion factors via a fitting procedure using the programming interface.

In a particular embodiment, the scaling and distortion factors in addition (or as an alternative) to the donor and receiver band indices (i,j) representing predetermined, average values based on training data are functions of measurable features of the (actual) donor band such as energy level/(ideally sound pressure level), spectral peakiness p, gain margin, etc. In an embodiment, a number of gain factors $G_{ij}$ and/or distortion factors $D_{ij}$ for a given band substitution i→j are determined (and stored) as a function of the donor band feature values, e.g. $G_{ij}(l,p)$ and $D_{ij}(l,p)$. In this case, one would measure energy level l and spectral peakiness p for each candidate donor band i, and determine the resulting distortion for each donor band by consulting the stored $D_{ij}(l,p)$ values. Preferably, the donor band leading to the lowest expected distortion would be used. The gain value needed to obtain this distortion would then be found by look-up in the stored $G_{ij}(l,p)$ values. This provides an improved quality (less distortion) of the processed signal. In an embodiment, the listening device is adapted to analyse an input signal and determine its characteristics, and to select an appropriate one of the gain $G_{ij}$- and/or distortion $D_{ij}$-factors to be used in the spectral substitution process.

In a particular embodiment, the listening device is adapted to provide that for a given receiver band j, the donor band i having the lowest expected distortion factor $D_{ij}$ is selected for the substitution, whereby the distortion of the processed signal is minimized.

In a particular embodiment, the listening device further comprises a feedback loop from the output side to the input side comprising an adaptive FBC filter comprising a variable filter part for providing a specific transfer function and an update algorithm part for updating the transfer function (e.g. filter coefficients) of the variable filter part, the update algorithm part receiving first and second update algorithm input signals from the input and output side of the forward path, respectively. This has the advantage of supplementing the contribution to feedback cancellation provided by the spectral band substitution unit.

In a particular embodiment, the listening device is adapted to provide that one of the update algorithm input signals (e.g. the second) is based on the SBS-processed output signal.

In a polar notation, a complex valued parameter (such as LG, FG, FBG), e.g. $LG=x+i\cdot y=Re(LG)+i\cdot Im(LG)$ (where i is the imaginary unit, and 'Re' refer to the REAL part and 'Im' to the IMAGINARY part of the complex number), may be written as $MAG(LG)\cdot exp(i\cdot ARG(LG))$, where MAG is the magnitude of the complex number $MAG(LG)=|LG|=SQRT(x^2+y^2)$ and ARG is the argument or angle of the complex number (the angle of the vector (x,y) with the x-axis, of an ordinary xy coordinate system, $ARG(LG)=Arctan(y/x)$).

In a particular embodiment, the listening device is adapted to provide that a condition for selecting a frequency band as plus band is that it fulfils both criteria a) AND b), i.e. a) that the magnitude of LG is close to 1, AND b) that the argument of LG is close to 0 (or a multiple of $2\cdot\pi$). In an embodiment, the listening device is adapted to provide that MAG(LG) for the band in question is within a range between 0.5 and 1, such as within between 0.8 and 1, such as within a range between 0.9 and 1, such as within a range between 0.95 and 1, such as within a range between 0.99 and 1, AND that for that band ARG(LG) is within a range of +/−40° around 0°, such as within a range of +/−20° around 0°, such as within a range of +/−10° around 0°, such as within a range of +/−5° around 0°, such as within a range of +/−2° around 0°.

In a particular embodiment, the listening device is adapted to provide that a condition for selecting a frequency band $FB_i$ as plus band is that for that band $MAG(H_{cl}(FB_i))$ is larger than a factor $K_+$ times $MAG(FG(FB_i))$, where $K_+$ is e.g. larger than 1.3, such as larger than 2, such as larger than 5, such as larger than 10, such as larger than 100, where $H_{cl}(FB_i)$ and $FG(FB_i)$ are corresponding current values of the closed loop transfer function of the listening device and the forward gain, respectively, in frequency band i. In a particular embodiment, $K_+$ is independent of frequency (or frequency band). In an embodiment, $K_+(FB_i)$ decreases with increasing frequency, e.g. linearly, e.g. with a rate of 0.5-2, e.g. 1, per kHz. In a particular embodiment, the listening device is adapted to provide that a condition for selecting a frequency band $FB_i$ as minus band is that for that band $MAG(H_{cl}(FB_i))$ is smaller than or equal to a factor $K_-$ times $MAG(FG(FB_i))$, where $K_-\leq K_+$. In an embodiment, $K_-\leq 0.8\cdot K_+$, such as $K_-\leq 0.5\cdot K_+$, such as $K_-\leq 0.2\cdot K_+$.

In a particular embodiment, the magnitude of loop gain, $MAG(LG(FB_i))$, at a given frequency or a given frequency band i is used to define a criterion for a band being a plus band (irrespective of the phase of the complex valued loop gain). In an embodiment, solely the magnitude of loop gain is used to define a criterion for a band being a plus band.

In a particular embodiment, the listening device is adapted to provide that a condition for selecting a frequency band as plus band is that the magnitude of loop gain MAG(LG) is larger than a plus-level, e.g. larger than −12 dB, such as larger than −6 dB, such as larger than −3 dB, such as larger than −2 dB, such as larger than −1 dB.

In a particular embodiment, the listening device is adapted to provide that a condition for selecting a frequency band as a minus band is that the band has an estimated loop gain in that band smaller than a minus-level.

In a particular embodiment, the minus-level is equal to the plus-level of estimated loop gain. In an embodiment, the plus-level defining the lower level of a plus-band is different from (larger than) the minus-level defining the upper level of a minus-band. In an embodiment, the difference between the plus-level and the minus-level is 1 dB, such as 2 dB, such as 3 dB or larger than 3 dB. In a particular embodiment, a minus-band has a relatively low loop gain, e.g. less than a minus-level of −10 dB. In a particular embodiment, the listening device is adapted to provide that a condition for selecting a frequency band $FB_i$ as minus band is that for that band the minus-level is smaller than or equal to a factor $KL_-$ times the plus-level, where $KL_-\leq 0.8$, such as $KL_-\leq 0.5$, such as $KL_-\leq 0.2$, such as $KL_-\leq 0.05$.

In an embodiment, the listening device is adapted to use different criteria for identifying a plus-band in different parts of the frequency range, e.g. so that a 'LG-magnitude criterion' is used in some frequency bands and a 'closed-loop transfer-function criterion' is used in other frequency bands. This has the advantage that a more relaxed (and less calculation intensive) criterion can be applied in frequency bands that are less prone to acoustic feedback, thereby saving computing power.

In a particular embodiment, the listening device comprises a hearing instrument, a head set, an ear protection device, an ear phone or any other portable communication device comprising a microphone and a receiver located relatively close to each other to 'enable' acoustic feedback.

A method of minimizing howl in a listening device is furthermore provided by the present invention, the method comprising converting an input sound to an electric input signal, and converting a processed electric output signal to an output sound, defining an electric forward path of the listening device from the electric input signal to the processed electric output signal, and providing processing of an input signal in a number of frequency bands, and estimating loop gain in each frequency band, thereby identifying plus-bands having an estimated loop gain according to a plus-criterion and minus-bands having an estimated loop gain according to a minus-criterion, and substituting spectral content in a receiver band of the input signal with spectral content from a donor band based on estimated loop gain in such a way that spectral content of the donor band is copied and possibly scaled with a scaling function and inserted in the receiver band, and providing a processed electric output signal, providing that the receiver band is a plus-band and the donor band is a minus-band.

The method has the same advantages as the corresponding product. It is intended that the features of the corresponding listening device as described above, in the section on modes for carrying out the invention and in the claims can be combined with the present method when appropriately converted to process-features.

In a particular embodiment, gain values, $G_{ij}$, representing scaling factors to be multiplied onto the spectral content from donor band i when copied (and possibly scaled) to receiver band j have—prior to the actual use of the listening device—been stored in a K×K gain matrix G of a memory accessible by the listening device. Similarly, in a particular embodiment, distortion values, $D_{ij}$, representing the distortion to be expected when performing the substitution from band i to band j have—prior to the actual use of the listening device—been stored in a K×K distortion matrix D of a memory accessible by the listening device.

Preferably, the method comprises that when band j must be substituted, and several possible donor bands are available, the donor band leading to the lowest expected distortion (e.g. based on a model of the human auditory system, e.g. customized to a user's hearing impairment) is used.

Use of a listening device as described above, in the detailed description of 'mode(s) for carrying out the invention' and in the claims, is moreover provided by the present invention.

A tangible computer-readable medium storing a computer program comprising program code means for causing a data processing system to perform at least some of the steps of the method described above, in the detailed description of 'mode (s) for carrying out the invention' and in the claims, when said computer program is executed on the data processing system is furthermore provided by the present invention. In addition to being stored on a tangible medium such as diskettes, CD-ROM-, DVD-, or hard disk media, or any other machine readable medium, the computer program can also be transmitted via a transmission medium such as a wired or wireless link or a network, e.g. the Internet, and loaded into a data processing system for being executed at a location different from that of the tangible medium.

A data processing system comprising a processor and program code means for causing the processor to perform at least some of the steps of the method described above, in the detailed description of 'mode(s) for carrying out the invention' and in the claims is furthermore provided by the present invention.

Further objects of the invention are achieved by the embodiments defined in the dependent claims and in the detailed description of the invention.

As used herein, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will be understood that when an element is referred to as being "connected" or "coupled" to another element, it can be directly connected or coupled to the other element or intervening elements maybe present, unless expressly stated otherwise. Furthermore, "connected" or "coupled" as used herein may include wirelessly connected or coupled. As used herein, the term "and/or" includes any and all combinations of one or more of the associated listed items. The steps of any method disclosed herein do not have to be performed in the exact order disclosed, unless expressly stated otherwise.

BRIEF DESCRIPTION OF DRAWINGS

The invention will be explained more fully below in connection with a preferred embodiment and with reference to the drawings in which.

The figures are schematic and simplified for clarity, and they just show details which are essential to the understanding of the invention, while other details are left out.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

MODE(S) FOR CARRYING OUT THE INVENTION

Figure 1A:
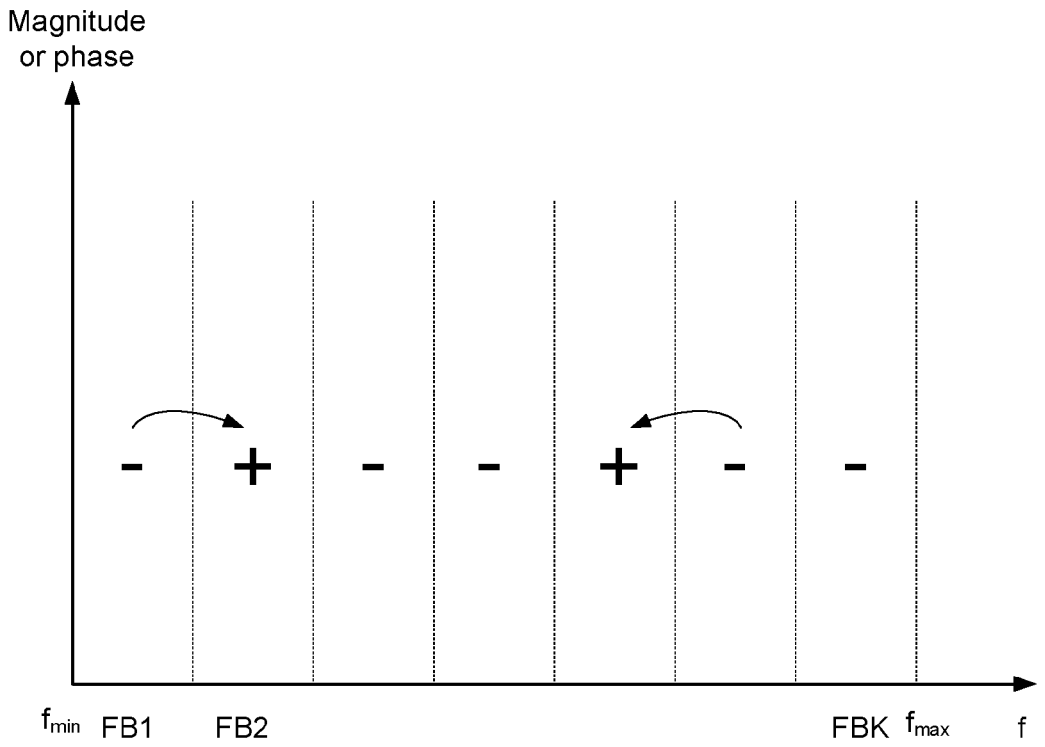
FIG. 1 illustrates the scheme for spectral band substitution according to the invention in FIG. 1*a* and examples of 'spectral content' of a band in FIG. 1*b*.
Figure 1B:
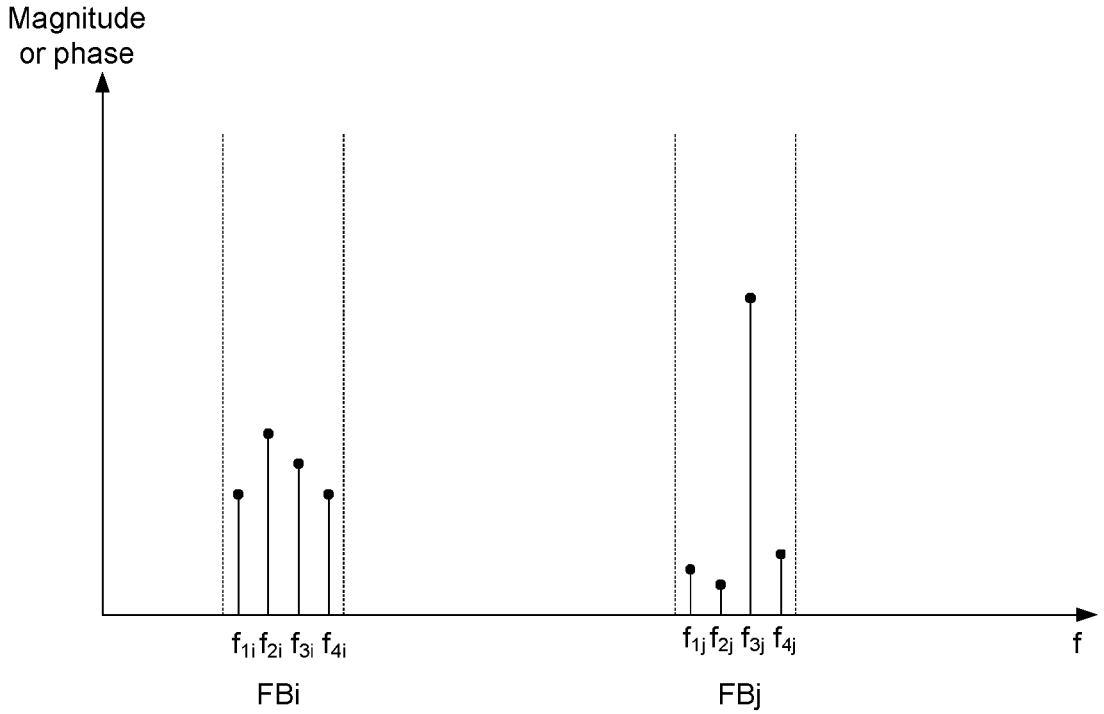

FIG. 1 shows a scheme for spectral band substitution according to an embodiment of the invention in FIG. 1*a* and examples of 'spectral content' of a band in FIG. 1*b*. The frequency axis in FIG. 1*a* is divided into K non-overlapping sub-bands. In an embodiment, the frequency range constituted by the K bands is 20 Hz to 12 kHz. In an embodiment, the number of bands is 64. In FIG. 1*a*, two sub bands have been identified by an LG-estimator unit (cf. FIG. 2) to have a relatively large loop gain, e.g. larger than −2 dB, (indicated by '+') while the other sub bands have relatively low estimated loop gains, e.g. smaller than −10 dB (indicated by '−'). Based on an input from an LG-estimator unit, an SBS unit (cf. FIG. 2) is adapted for substituting spectral content in a receiver band of the input signal with the (possibly scaled) spectral content of a donor band wherein the receiver band is a plus-band (indicated by '+' in FIG. 1*a*) and the donor band is a minus-band (indicated by '−' in FIG. 1*a*).

In an embodiment, an input signal is adapted to be arranged in time frames, each time frame comprising a predefined number N of digital time samples $x_n$ (n=1, 2, . . . , N), corresponding to a frame length in time of $L=N/f_s$, where $f_s$ is a sampling frequency of an analog to digital conversion unit. A frame can in principle be of any length in time. In the present context a time frame is typically of the order of ms, e.g. more than 5 ms. In an embodiment, a time frame has a length in time of at least 8 ms, such as at least 24 ms, such as at least 50 ms, such as at least 80 ms. The sampling frequency can in general be any frequency appropriate for the application (considering e.g. power consumption and bandwidth). In an embodiment, the sampling frequency of an analog to digital conversion unit is larger than 1 kHz, such as larger than 4 kHz, such as larger than 8 kHz, such as larger than 16 kHz, such as larger than 24 kHz, such as larger than 32 kHz. In an embodiment, the sampling frequency is in the range between 1 kHz and 64 kHz. In an embodiment, time frames of the input signal are processed to a time-frequency representation by transforming the time frames on a frame by frame basis to provide corresponding spectra of frequency samples (e.g. by a Fourier transform algorithm), the time frequency representation being constituted by TF-units each comprising a complex value of the input signal at a particular unit in time and frequency. The frequency samples in a given time unit may be arranged in bands $FB_k$ (k=1, 2, . . . , K), each band comprising one or more frequency units (samples).

FIG. 1*b* illustrates examples of spectral content of frequency bands $FB_i$ and $FB_j$ (at a given time unit $t_p$). A frequency band may in general comprise (generally complex) signal values at any number of frequencies. In the shown embodiment, a frequency band contains 4 frequencies $f_1$, $f_2$, $f_3$, $f_4$. The spectral content of frequency band i ($FB_i$) contains the magnitude (and phase) values of the signal (at a given time or corresponding to a given time frame) at the four frequencies $f_{1i}$, $t_{2i}$, $f_{3i}$, $f_{4i}$ of frequency band i, $FB_i$. In an embodiment, only the magnitude values of the signal are considered in the substitution process (while the phase values are left unaltered or randomized or multiplied by a complex-valued constant with unit magnitude). In FIG. 1*b*, the spectral values observed in frequency band $FB_i$ are relatively equal in size, whereas the spectral values indicated for $FB_j$ are more variable (or peaky, a peak at $f_{3j}$ is conspicuous). The 'spectral content' of frequency band i, $FB_i$, at the given time is e.g. represented in FIG. 1*b* by the four magnitudes $MAG_{1i}$, $MAG_{2i}$, $MAG_{3i}$, $MAG_{4i}$ of the signal as indicated by the lengths of the four lines ending with a solid dot at the corresponding frequencies $f_{1i}$, $t_{2i}$, $f_{3i}$, $f_{4i}$ of $FB_i$. Substitution of the spectral content of a receiver band, e.g. $FB_j$, with the spectral content of a donor band, e.g. $FB_i$, can e.g. be performed by substituting $MAG_{jq}$ with $MAG_{iq}$, q=1, 2, 3, 4.

Preferably a scaling factor $G_{ij}$ is used so that $MAG_{jq}$ is substituted by $G_{ij} \cdot MAG_{iq}$, q=1, 2, 3, 4. In an embodiment $G_{ij}$ is adapted to provide that the average value of $G_{ij} \cdot MAG_{iq}$ is equal to the average value of $MAG_{jq}$. In an embodiment, $G_{ij}$ is a function of frequency also, so that 4 different gain factors $G_{ijq}$ (q=1, 2, 3, 4) are used. Corresponding phase angle values $ARG_{iq}$ (q=1, 2, 3, 4) of the donor band may be left unaltered (if e.g. the gain values $G_{ij}$ are real numbers) or scaled (if gain values $G_{ij}$ are complex), e.g. according to a predefined scheme, e.g. depending on the frequency distance between the donor $FB_i$ and receiver $FB_j$ bands.

Figure 2:
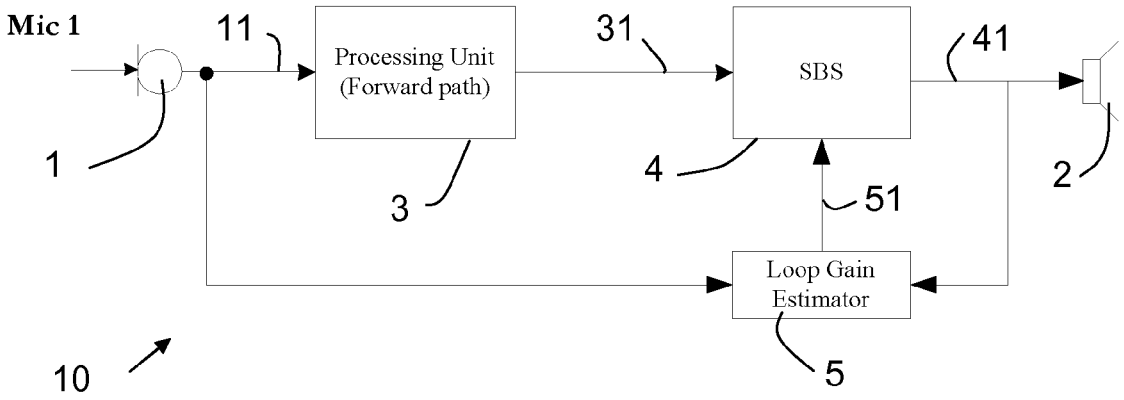
FIG. 2 shows a block diagram of a listening device, e.g. a hearing instrument, according to an embodiment of the invention using the proposed spectral band substitution method.

FIG. 2 shows a block diagram of a listening device, e.g. a hearing instrument, according to an embodiment of the invention adapted to use the proposed spectral band substitution method. The listening device (e.g. a hearing instrument) 10 comprises a microphone 1 (Mic 1 in FIG. 2) for converting an input sound to an electric input signal 11 and a receiver 2 for converting a processed electric output signal 41 to an output sound. A forward path is defined between the microphone 1 (input side) and the receiver 2 (output side), the forward path comprising a signal processing unit 3 (Processing unit (Forward path) in FIG. 2) for processing an input signal in a number of frequency bands. The listening device 10 further comprises an SBS unit 4 (SBS in FIG. 2) for performing spectral band substitution from one frequency band to another and providing an SBS-processed output signal 41, and an LG-estimator unit 5 (Loop Gain Estimator in FIG. 2) taking first 41 and second 11 inputs from the output side and the input side, respectively, for estimating loop gain in each frequency band thereby allowing the identification of plus-bands in the signal of the forward path having an estimated loop gain (magnitude) larger than a plus-level (or fulfilling another criterion for being a plus-band) and minus-bands having an estimated loop gain (magnitude) smaller than a minus-level (or fulfilling another criterion for being a minus-band). The LG-estimator unit 5, preferably receives an input from the signal processing unit 3 providing current forward gain values and possibly inputs from other 'sensors' providing information about the characteristics of the input signal and/or the current acoustic environment (e.g. noise level, direction to acoustic sources, e.g. to extract characteristics of or identify the type of the current acoustic signal, etc.). Based on an input 51 from the LG-estimator unit 5, the SBS unit 4 is adapted for substituting spectral content in a receiver band with spectral content from a donor band in such a way that spectral content of the donor band is copied and possibly scaled with a scaling function and inserted in the receiver band instead of its original spectral content. A receiver band is a plus-band and a donor band is a minus-band (optionally originating from another microphone than the input signal containing the receiver band). An example of a circuit for estimating loop gain at different predetermined frequencies is given in WO 94/09604 A1. Dynamic calculation of loop gain in each frequency band is described in WO 2008/151970 A1. Spectral band substitution in acoustic signals is e.g. dealt with in EP 1367566 B1 or WO 2007/006658 A1. The forward path may preferably additionally comprise analogue to digital (AD) and digital to analogue converters, time to frequency (t→f) conversion and frequency to time (f→t) conversion units (the latter being e.g. implemented as filter banks or, respectively, Fourier transform and inverse Fourier transform algorithms). One or more of such functionality may be included as separate units or included in one or more of the signal processing unit 3, the microphone system 1, the spectral band substitution unit 4, the loop gain estimator unit 5 and the receiver 2.

With the proposed scheme, it is possible to substitute spectral content from any sub band to any other sub band. The decision as to which sub-bands should preferably be used as 'donor' band is e.g. taken based on a priori knowledge of the resulting average perceptual distortion (as estimated by a perceptual distortion measure), e.g. stored in a memory of the listening device (or alternatively extracted from an external databases accessible to the listening device, e.g. via a wireless link). Preferably, the donor band leading to the lowest distortion is used.

EXAMPLE

A Spectral Band Substitution Algorithm

In the following, one way of implementing a simple version of the proposed scheme is described. In this realization, spectral band substitution is performed by copying the spectral content from a donor band (band i) to the receiver band (band j), and the spectral content (of the donor band) is scaled by a single scalar gain value ($G_{ij}$). Prior to run-time (e.g. during a fitting procedure or at manufacturing), the gain values have been stored in a K×K gain matrix G. The entry at row i and column j, $G_{ij}$, is the gain that must be multiplied onto the spectral content from donor band i when copied to receiver band j. Similarly, before run-time, a K×K distortion matrix D has been constructed whose elements ($D_{ij}$) characterize the distortion to be expected when performing the substitution from band i to band j. When band j must be substituted, and several possible donor bands are available, the donor band leading to the lowest expected distortion is preferably used. The gain and expected distortion matrices G and D are preferably constructed before run-time (i.e. before the listening device is actually taken into normal operation by a user), e.g. by using a large set of training data representative of the signals encountered in practice (e.g., if it is known that the target signal is speech, the training procedure involves a large set of speech signals). The construction procedure can be outlined as follows. For a given signal frame (i.e. a spectral representation of the signal at a given time $t_p$), donor band i and receiver band j, several candidate gain factors $G_{ij}$ are tried out and for each, the resulting distortion as perceived by a (possibly hearing impaired) human listener is estimated. More specifically, this perceived distortion is estimated using an algorithm which compares a non-modified version of the signal frame in question with a signal frame where the substitution in question has been performed; the algorithm outputs a distance measure which, ideally, correlates well with human perception. Several algorithms for performing this task exist; often, they employ a model of the human auditory system, see e.g. [Van de Par et al., 2008], to transform the original and modified signal frames to excitation patterns or 'inner-representations', i.e., abstractions of neural signal outputs from the inner ear. Measuring simple distance measures, e.g. mean-square error, between such inner representations tend to correlate well with human distortion detectability [Van de Par et al., 2008]. For each (i,j) combination, the gain value that leads to the lowest average distortion (computed across many signal frames) is used as entry $G_{ij}$ in matrix G, while the corresponding distortion is used as entry $D_{ij}$ in the expected distortion matrix.

The above described setup is relatively simple.

In another embodiment, the selection of the appropriate donor band is made dependent on characteristics of the current signal (and not solely relying on predetermined average gain and distortion factors when substituting spectral content from donor band i to receiver band j). This can e.g. be done by expanding the above described scheme such that the relevant gain and distortion values are functions of not only the donor and receiver band indices (i,j) (defining predetermined average gain and distortion factors), but also characteristics of the input signal, e.g. measurable features of the donor band such as energy level (ideally sound pressure level), spectral peakiness, gain margin, etc. In an embodiment, the selection of the appropriate donor band is made dependent solely on characteristics of the current signal (without relying on predefined average gain and distortion values). In an embodiment, the listening device comprises one or more detectors capable of identifying a number of characteristics of the current signal, e.g. the above mentioned characteristics.

Spectral peakiness refers to the degree of variation of the signal in the frequency band or range considered. The signal in frequency band j of FIG. 1*b* is e.g. more peaky than the signal of frequency band i. One of many measures of the peakiness of the samples of a particular frequency band is e.g. given by the standard deviation of the samples. A selection of a donor band based on its spectral peakiness has the advantage that spectrally peaked donor bands would be used for receiver bands which are typically/on average spectrally peaked and spectrally flat donor bands would generally by chosen for receiver bands which are typically spectrally flat.

In general the donor band and the receiver band originate from the same (input) signal. In an embodiment, however, the donor band is taken from another available microphone signal, e.g. from a second microphone of the same hearing aid, or from a microphone of a hearing aid in the opposite ear, or from the signal of an external sensor, e.g. a mobile phone or an audio selection device, etc.

Further, it is in principle possible to adapt the entries of the gain and expected distortion matrices over time. This can e.g. be done simply by repeating the training or construction procedure at run-time for sub bands for which the loop gain estimate is low, i.e., bands without noticeable influence of feedback (assuming that relevant parts of a (possibly user customized) model of the human auditory system is available to the listening device). The result of this is a system which is able to adapt and improve its performance over time, if exposed to a certain class of input signals, e.g., speech, classical music, etc.

Finally, since the proposed scheme is essentially based on decisions from a perceptual distortion measure, it is possible to make person-specific/hearing loss specific solutions by adapting the underlying model of the auditory system accordingly.

Figure 3:
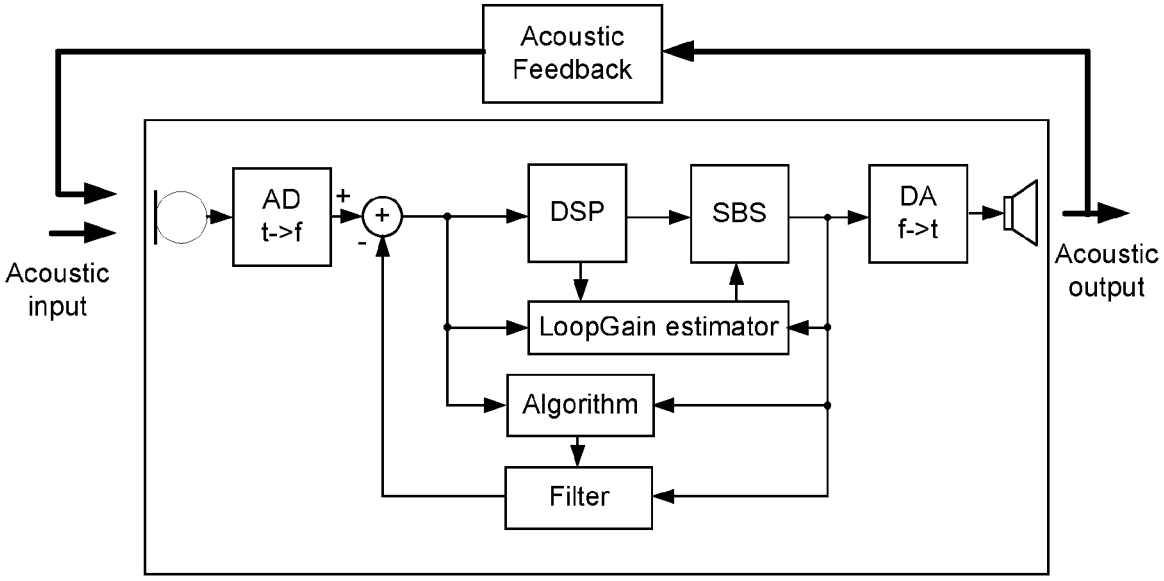
FIG. 3 shows a block diagram of a listening device according to an embodiment of the invention including an adaptive filter in a feedback correction loop.

FIG. 3 shows a block diagram of a listening device according to an embodiment of the invention including an adaptive filter in a feedback correction loop.

FIG. 3 illustrates a listening device, e.g. a hearing instrument, according to an embodiment of the invention. The hearing instrument comprises a forward path, an (unintentional) acoustical feedback path and an electrical feedback cancellation path for reducing or cancelling acoustic feedback. The forward path comprises an input transducer (here a microphone) for receiving an acoustic input from the environment, an analogue to digital converter and a time to frequency conversion unit (AD t→f-unit in FIG. 3) for providing a digitized time-frequency representation of the input signal, a digital signal processor DSP for processing the signal in a number of frequency bands, possibly adapting the signal to the needs of a wearer of the hearing instrument (e.g. by applying a frequency dependent gain), an SBS unit (SBS) for substituting a receiver band comprising howl with a donor band without howl, a digital to analogue converter and a frequency to time conversion unit (DA f→t-unit in FIG. 3) for converting a digitized time-frequency representation of the signal to an analogue output signal and an output transducer (here a receiver) for generating an acoustic output to the wearer of the hearing aid. An (mainly external, unintentional) Acoustical Feedback from the output transducer to the input transducer is indicated. The electrical feedback cancellation path comprises an adaptive filter (Algorithm, Filter), whose filtering function (Filter) is controlled by a prediction error algorithm (Algorithm), e.g. an LMS (Least Means Squared) algorithm, in order to predict and preferably cancel the part of the microphone signal that is caused by feedback from the receiver to the microphone of the hearing instrument (as indicated in FIG. 3 by bold arrow and box Acoustic Feedback, here actually including the I/O-transducers and the AD/DA and t→f/f→T converters). The adaptive filter is aimed at providing a good estimate of the external feedback path from the electrical input to the f→t, DA converter via the output transducer to the electrical output of the AD, t→f converter via the input transducer. The prediction error algorithm uses a reference signal (here the output signal from the spectral band substitution unit, SBS) together with the (feedback corrected) input signal from the input transducer (microphone) (the error signal) to find the setting of the adaptive filter that minimizes the prediction error when the reference signal is applied to the adaptive filter. The acoustic feedback is cancelled (or at least reduced by subtracting (cf. SUM-unit '+' in FIG. 3) the estimate of the acoustic feedback path provided by the output of the Filter part of the adaptive filter from the (digitized, t→f converted) input signal from the microphone comprising acoustic feedback to provide the feedback corrected input signal. The hearing instrument further comprises an LG-estimator unit (LoopGain estimator in FIG. 3) for estimating loop gain in each frequency band thereby identifying plus-bands having an estimated loop gain larger than a plus-level (e.g. 0.95) and minus-bands having an estimated loop gain smaller than a minus-level (e.g. 0.95). A first input to the LG-estimator unit is the output of the SBS unit comprising the output signal after spectral substitution. A second input to the LG-estimator unit is the input signal corrected for feedback by the adaptive filter (output from the SUM unit '+'). In the embodiment of FIG. 3, the LG-estimator has a third input from the DSP unit, indicating that the gain values applied in the forward path from the DSP-unit is used to obtain an LG estimate (cf. input from DSP-unit to LoopGain estimator in FIG. 3). Further inputs to the LoopGain estimator from 'sensors' providing information about characteristics of the input signal (in particular the receiver and possible donor bands) may be included in the estimate of current loop gain and/or the selection of a relevant donor band. The LG-estimator thus works on a signal that has been 'preliminarily' corrected for acoustic feedback by the adaptive filter. Alternatively, the LG-estimator could be adapted to work on the signal before it is corrected by the adaptive filter. Alternatively, a further LG-estimator could be implemented, so that a first LG-estimator receives an input in the form of the input signal before correction by the adaptive filter and a second LG-estimator receives an input in the form of the input signal after correction by the adaptive filter (i.e. an input branched off the forward path before and after the sum unit ('+') in FIG. 3, respectively). In an embodiment, the SBS unit is located in the forward path before the signal processing unit DSP (as opposed to as shown in FIG. 3, where the SBS unit is located after the DSP). The enclosing rectangle indicates that the enclosed blocks of the listening device are located in the same physical body (in the depicted embodiment). Alternatively, the microphone and processing unit and feedback cancellation system can be housed in one physical body and the output transducer in a second physical body, the first and second physical bodies being in communication with each other. Other divisions of the listening device in separate physical bodies can be envisaged (e.g. the microphone may be located in a physical body separate from other parts of the listening device, the parts of the system being in communication with each other by wired or wireless connection). The hearing instrument may comprise an additional input transducer from which the donor band can be selected. Alternatively, the hearing instrument may receive a microphone signal (e.g. wirelessly) from a microphone located in a physically separate device, e.g. a contra-lateral hearing instrument. In an embodiment, some of the processing related to the spectral band substitution is performed in the signal processing unit DSP. In practice, the SBS unit (and/or the LoopGain estimator) may form part of a digital signal processor (i.e. be integrated with the DSP).

FIG. 4 illustrates and supports basic definitions of (acoustic) feedback gain and forward gain of a listening device, e.g. a hearing instrument.

Figure 4A:
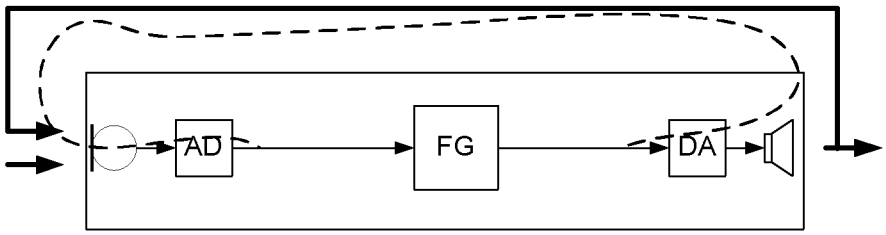
FIG. 4 illustrates basic definitions of feedback gain and forward gain of listening device, e.g. a hearing instrument, FIG. 4*a* illustrating a device comprising only a forward path, and FIG. 4*b* a corresponding mathematical representation, FIG. 4*c* illustrating a device comprising a forward path and a feedback cancellation system, and FIG. 4*d* a corresponding mathematical representation.
Figure 4B:
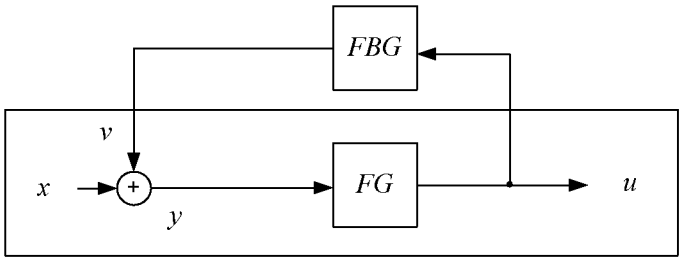

As is well-known, an oscillation due to acoustical feedback (typically from an external leakage path) and/or mechanical vibrations in the hearing aid can occur at any frequency having a loop gain larger than 1 (or 0 dB in a logarithmic expression) AND at which the phase shift around the loop is an integer multiple of 360°. A schematic illustration of a listening system is shown in FIG. 4*a*, the system comprising an input transducer (here illustrated by a microphone) for receiving an acoustic input (e.g. a voice) from the environment, an analog-digital converter AD, a processing part FG, a digital-analog converter DA and an output transducer (here illustrated by a speaker) for generating an acoustic output to the wearer of the listening system. The intentional forward path and components of the system are enclosed by the solid outline. A frequency (f) dependent (partly 'external', unintentional) feedback from the output transducer to the input transducer is indicated. In the present context, the feedback path FBG(f) is defined from the input of the DA converter through the receiver and microphone to the output of the AD converter as indicated by the dashed arrow in FIG. 4*a*, and the forward path is defined by the path closing the loop from the output of the AD converter to the input of the DA converter, here represented by the processing block FG(f). The interface between forward path and feedback path may be moved to other locations (e.g. to include the AD- and DA-converters in the forward path), if convenient for the calculations in question, the feedback path at least comprising the 'external' part from the output of the output transducer to the input of the input transducer. The AD and DA converter blocks may include time to frequency and frequency to time converters, respectively, to allow the input signal to be processed in a time frequency domain. Alternatively, time to frequency and frequency to time conversion (e.g. Fourier and inverse Fourier conversion, respectively, e.g. implemented as software algorithms) may form part of the forward path, e.g. implemented in a signal processing unit providing a (time and) frequency dependent forward gain FG(f). The (time and) frequency dependent open loop gain LG(f) of the loop constituted by the forward path and the feedback path is determined by the product FG*FBG of forward gain and feedback gain. FIG. 4*b* is a mathematical representation of the diagram of FIG. 4*a* constituted by the forward and feedback paths. FIG. 4*b* indicates that the output signal u is equal to the sum of the (target) input signal x and the acoustic feedback signal v times the forward gain FG, i.e. $u=[x+v]\cdot FG=[x+u\cdot FBG]\cdot FG$, where the (time and) frequency dependence is implicit (i.e. not indicated).

Figure 4C:
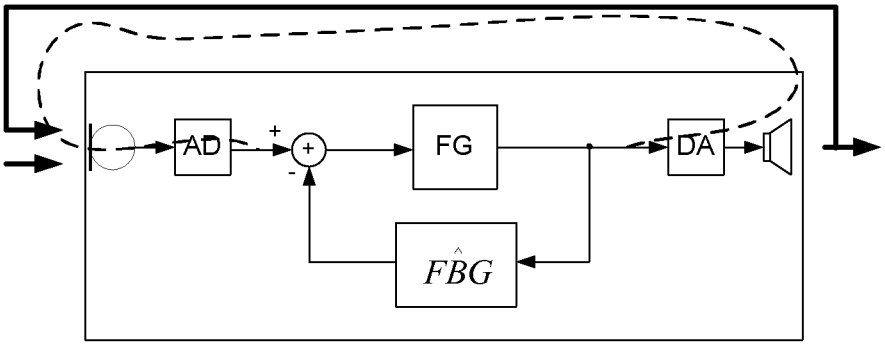
Figure 4D:
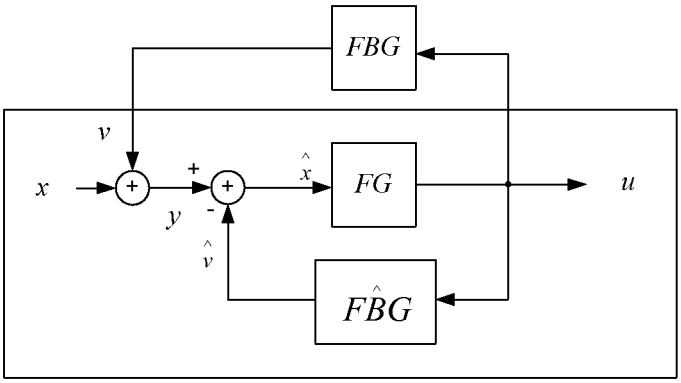

FIG. 4*c* illustrates a listening system as in FIG. 4*a*, which—in addition to the forward path (including an external leakage or acoustic feedback path FBG)—comprises an electric feedback path $F\hat{B}G$ with a gain and phase response aimed at estimating the external leakage path (here represented by the dashed line in FIG. 4*d*). The estimate $F\hat{B}G$ is subtracted from the input signal from the microphone (possibly digitized in the AD-converter), thereby ideally cancelling the contribution from the external feedback path. In this case, the loop gain LG is given by the product $FG*(FBG-F\hat{B}G)$. The $F\hat{B}G$ block can e.g. be implemented by a feedback estimation unit, e.g. an adaptive filter.

FIG. 4*d* shows a mathematical representation of the diagram in FIG. 4*c* comprising the signals necessary to define a closed loop transfer function $H_{cl}=OUT/IN=u/x$. From FIG. 4*d* it appears that $u=[x+v-\hat{v}]\cdot FG=[x+u\cdot FBG-u\cdot F\hat{B}G]\cdot FG$, with $LG=FG\cdot(FBG-F\hat{B}G)$ leading to $$H_{cl}=\frac{FG}{1-LG},$$

where u, x, v, $\hat{v}$ in general are frequency dependent (e.g. digital) complex valued signals at a given time, and $H_{cl}$, FG and LG are complex valued, frequency (and time) dependent closed loop transfer function, forward gain and loop gain, respectively (as e.g. obtained by Fourier transformation of time dependent signals (at regular points in time)). In a polar notation, the complex valued parameters, e.g. $LG=x+i\cdot y=Re(LG)+i\cdot Im(LG)$ (where i is the imaginary unit), may be written as $MAG(LG)\cdot\exp(i\cdot ARG(LG))=r\cdot e^{i\cdot\Phi}$, where MAG is the magnitude of the complex number $|LG|=r=SQRT(x^2+y^2)$ and ARG is the argument or angle of the complex number (the angle of the vector (x,y) with the x-axis, $ARG(LG)=\phi=Arctan(y/x)$).

A condition for a frequency band $FB_i$ to have a value of loop gain risking causing oscillation (and hence to be termed a plus-band in the sense of this aspect of the present invention) is thus that the argument of LG is close to 0 (or a multiple of $2\cdot\pi$) AND the magnitude of LG is close to 1 (i.e. the Imaginary part of LG is close to 0 and the REal part of LG is close to +1).

In an embodiment, a condition for selecting a frequency band as plus band is that for that band ARG(LG) is within a range of +/−10° around 0°, such as within a range of +/−5° around 0°, such as within a range of +/−2° around 0°, AND that MAG(LG) for the band in question is within a range of +/−0.2 around 1, such as within a range of +/−0.1 around 1, such as within a range of +/−0.05 around 1, such as within a range of +/−0.01 around 1. In an embodiment, a condition for selecting a frequency band as plus band is that for that band ARG(LG) is within a range of +/−20° around 0°, such as within a range of +/−10° around 0°, such as within a range of +/−5° around 0°, such as within a range of +/−2° around 0°, AND that MAG(LG) for the band in question is larger than 0.5, such as larger than 0.8, such as larger than 0.9, such as larger than 0.95, such as larger 0.99.

In an embodiment, a condition for selecting a frequency band as a plus band is that for that band $MAG(H_{cl}(FB_i))$ is larger than $2\cdot MAG(FG(FB_i))$, such as larger than $5\cdot MAG(FG(FB_i))$, such as larger than $10\cdot MAG(FG(FB_i))$, such as larger than $100\cdot MAG(FG(FB_i))$. In an embodiment, a condition for selecting a frequency band as a minus band is that for that band $MAG(H_{cl}(FB_i))$ is smaller than or equal to $MAG(FG(FB_i))$.

Figure 5:
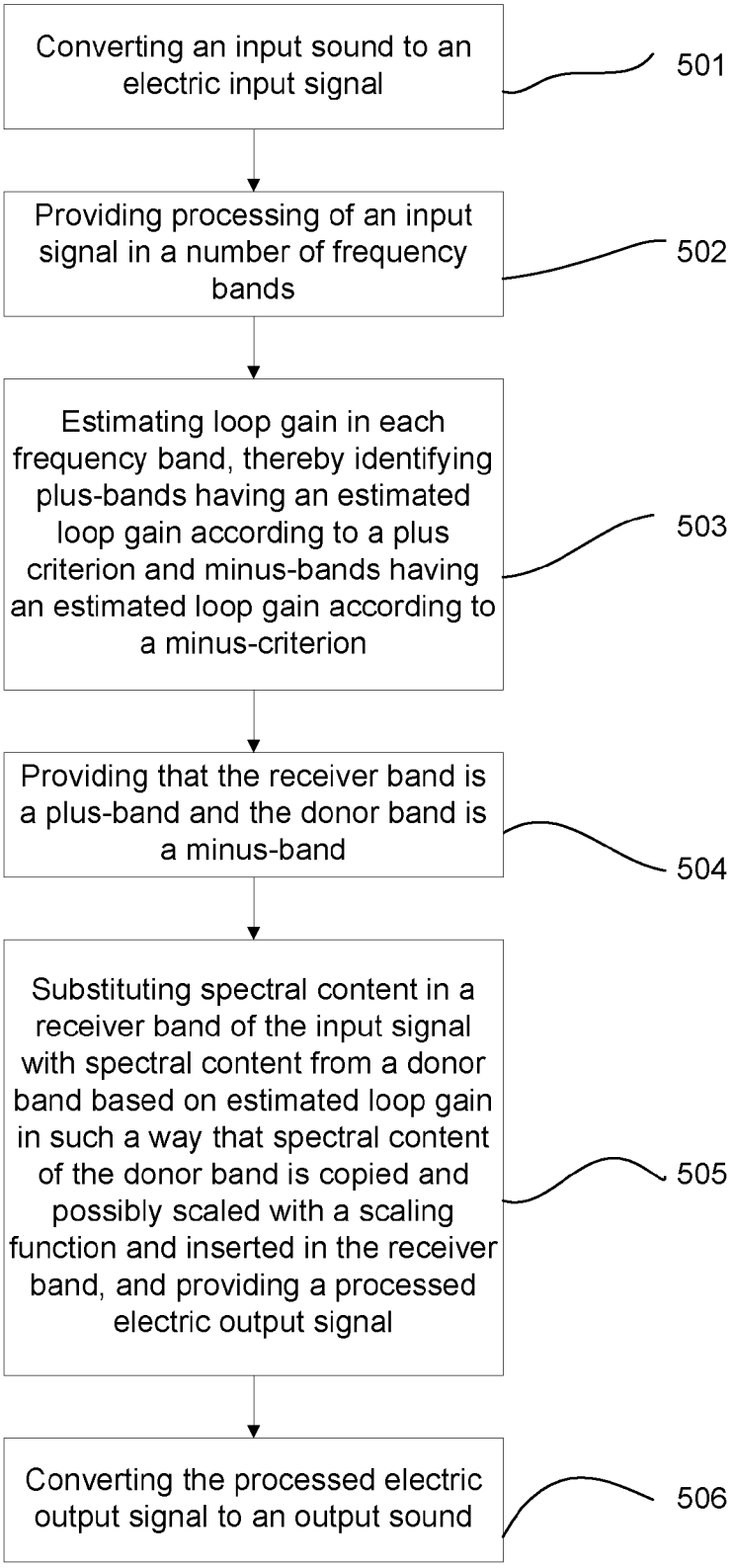
FIG. 5 shows a flowchart for a method of minimizing howl in a listening device according to the present invention.

FIG. 5 shows a flowchart for a method of minimizing howl in a listening device according to the present invention.

The method comprises the following steps (501-506):

501 Converting an input sound to an electric input signal;

502 Providing processing of an input signal in a number of frequency bands;

503 Estimating loop gain in each frequency band, thereby identifying plus-bands having an estimated loop gain according to a plus-criterion and minus-bands having an estimated loop gain according to a minus-criterion;

504 Providing that the receiver band is a plus-band and the donor band is a minus-band;

505 Substituting spectral content in a receiver band of the input signal with spectral content from a donor band based on estimated loop gain in such a way that spectral content of the donor band is copied and possibly scaled with a scaling function and inserted in the receiver band, and providing a processed electric output signal; and

506 Converting a processed electric output signal to an output sound.

In an embodiment, at least some of the steps 502, 503, 504, 505, such as a majority of the steps, e.g. all of the steps, are fully of partially implemented as software algorithms running on a processor of a listening device.

The method may additionally comprise other steps relating to the processing of a signal in a listening device, such processing steps typically being performed before the conversion of the processed signal to an output sound. In an embodiment, the method comprises analogue to digital conversion. In an embodiment, the method comprises digital to analogue conversion. In an embodiment, the method comprises steps providing a conversion from the time domain to the time-frequency domain and vice versa. In an embodiment, the signal to be processed is provided in successive frames each comprising a frequency spectrum of the signal in a particular time unit, each frequency spectrum being constituted by a number of time-frequency units, each comprising a complex valued component of the signal corresponding to that particular time and frequency unit.

Figure 6:
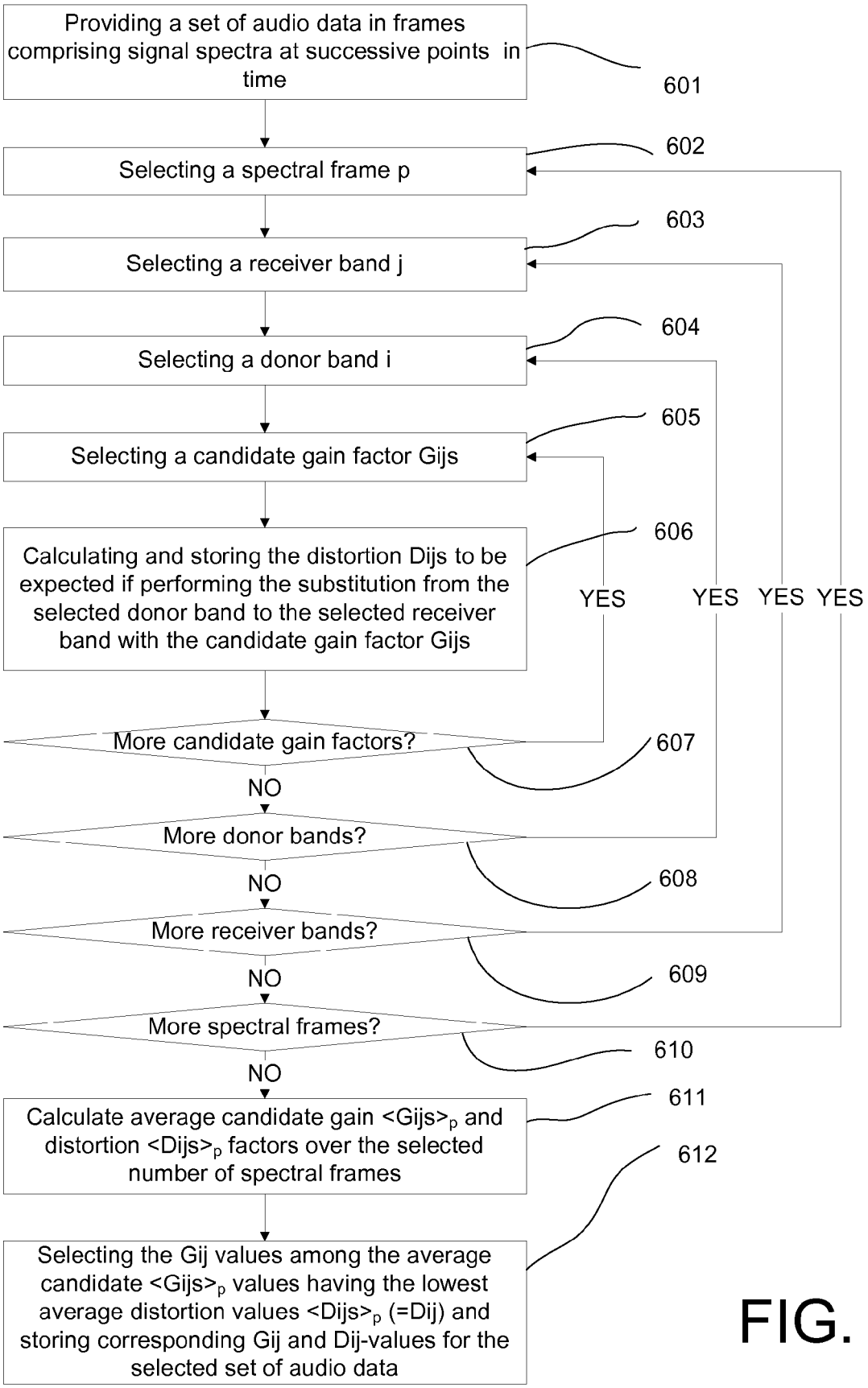
FIG. 6 shows a flowchart for a method of determining gain and distortion factors for use in a selection of a donor-band according to an embodiment of the present invention.

FIG. 6 shows a flowchart for a method of determining gain and distortion factors for use in a selection of a donor-band. The method deals with the creation of a gain matrix G comprising K×K gain factors $G_{ij}$ representing the gain that must be multiplied onto the spectral content from donor band i when copied to receiver band j for a given set of audio data and a corresponding distortion matrix D of K×K distortion factors $D_{ij}$ representing the distortion to be expected when performing the substitution from band i to band j for a given set of audio data. The method can e.g. start from one or more sets of audio data arranged in successive time frames each comprising a number of sampled (amplitude) values of an audio signal at discrete points in time (e.g. provided as a result of an analogue acoustic signal being sampled with a predefined sampling frequency).

The method comprises the following steps (601-612):

601: Providing a set x of audio data in frames comprising signal spectra at successive points in time;

602: Selecting a spectral frame p;

603: Selecting a receiver band j;

604: Selecting a donor band i;

605: Selecting a candidate gain factor $G_{ijs}$;

606: Calculating and storing the distortion factor Dijs to be expected if performing the substitution from the selected donor band to the selected receiver band with the candidate gain factor Gijs;

607: More candidate gain factors? If YES, go to step 605 (s=s+1≤S); if NO, go to step 608;

608: More donor bands? If YES, go to step 604 (i=i+1≤K); if NO, go to step 609;

609: More receiver bands? If YES, go to step 603 (j=j+1≤K); if NO, go to step 610;

610: More spectral frames? If YES, go to step 602 (p=p+1≤P); if NO, go to step 811;

611: Calculate average candidate gain $\langle Gijs \rangle_p$ and distortion $\langle Dijs \rangle_p$ factors over the selected number of spectral frames, $\langle x \rangle_p$ meaning an average of x over the p=1, 2, . . . , P spectral frames;

612: Selecting the Gij values among the average candidate $\langle Gijs \rangle_p$ values having the lowest average distortion values $\langle Dijs \rangle_p$ (=Dij) and storing corresponding Gij- and Dij-values for the selected set x of audio data.

In an embodiment, at least some of the steps 601, 602, 603, 604, 605, 606, 607, 608, 609, 610, 611 and 612 such as a majority of the steps, e.g. all of the steps, are fully of partially implemented as software algorithms for running on a processor of a listening device.

In an embodiment, the gain factors are selected according to a predefined scheme or an algorithm, e.g. running through a predefined gain-range from a min-value (Gij,min), e.g. 0, to a max-value (Gij,max) in fixed steps (s=1, 2, . . . , S) of predetermined (e.g. equal) step-size.

In an embodiment, the gain values are real numbers. In that case, only the magnitude values of the spectral content of the donor band are scaled.

Alternatively, the gain values can be complex numbers. In an embodiment, the phase angle values of the original spectral content of the receiver band are left unchanged. In an embodiment, the phase angle values of the donor band are scaled dependent on the distance in frequency between the donor band and the receiver band.

The method illustrated in FIG. 6 provides a gain G(x) and a distortion D(x) matrix for a single set (x) of audio data (averaged over the P frames of spectral data constituting the set of audio data in question). It may be run for a number of audio data sets x=1, 2, . . . , X. In an embodiment, the gain and distortion matrices may further be averaged over a number of audio data sets x=1, 2, . . . , X. In an embodiment, different sets of audio data represent different listening situations (one speaker, multiple speakers, auditory environment, classical music, rock music, TV-sound, peaceful environment, sports environment, etc.). In an embodiment, different gain and distortion matrices are stored (e.g. in the listening device) for different listening situations. In an embodiment, the listening device comprises an environment detector capable of identifying a number of listening situations.

In an embodiment the method is performed in an off-line procedure, e.g. in advance of a listening device is taken in normal use. In an embodiment, the gain and distortion matrices are loaded into a memory of a listening device via a (wired or wireless) programming interface to a programming device, e.g. a PC, e.g. running a fitting software for the fitting of the listening device. A distortion matrix is e.g. determined based on a model of the human auditory system.

In an embodiment, the method is performed in an on-line procedure, during a learning phase of an otherwise normal use of the listening device.

In an embodiment, only average values of the gain and distortion matrices determined by the method are stored in the listening device. In an embodiment, gain and distortion matrices for different types of signals are stored in the listening device, e.g. a set of audio data with one speaker in a silent environment, a set of audio data with one speaker in a noisy environment, a set of audio data with multiple voices in a noisy environment, etc., and the appropriate one of the stored matrices be consulted dependent upon the type of the current signal. Alternatively or additionally, values of the gain and distortion matrices for signals having different characteristics, such as energy level l (ideally sound pressure level), spectral peakiness p, gain margin, etc. can be stored, and the appropriate one of the stored matrices be consulted dependent upon the characteristics of the current signal. Thereby an appropriate gain and distortion matrix can be consulted dependent upon the actually experienced signals.

Figure 7:
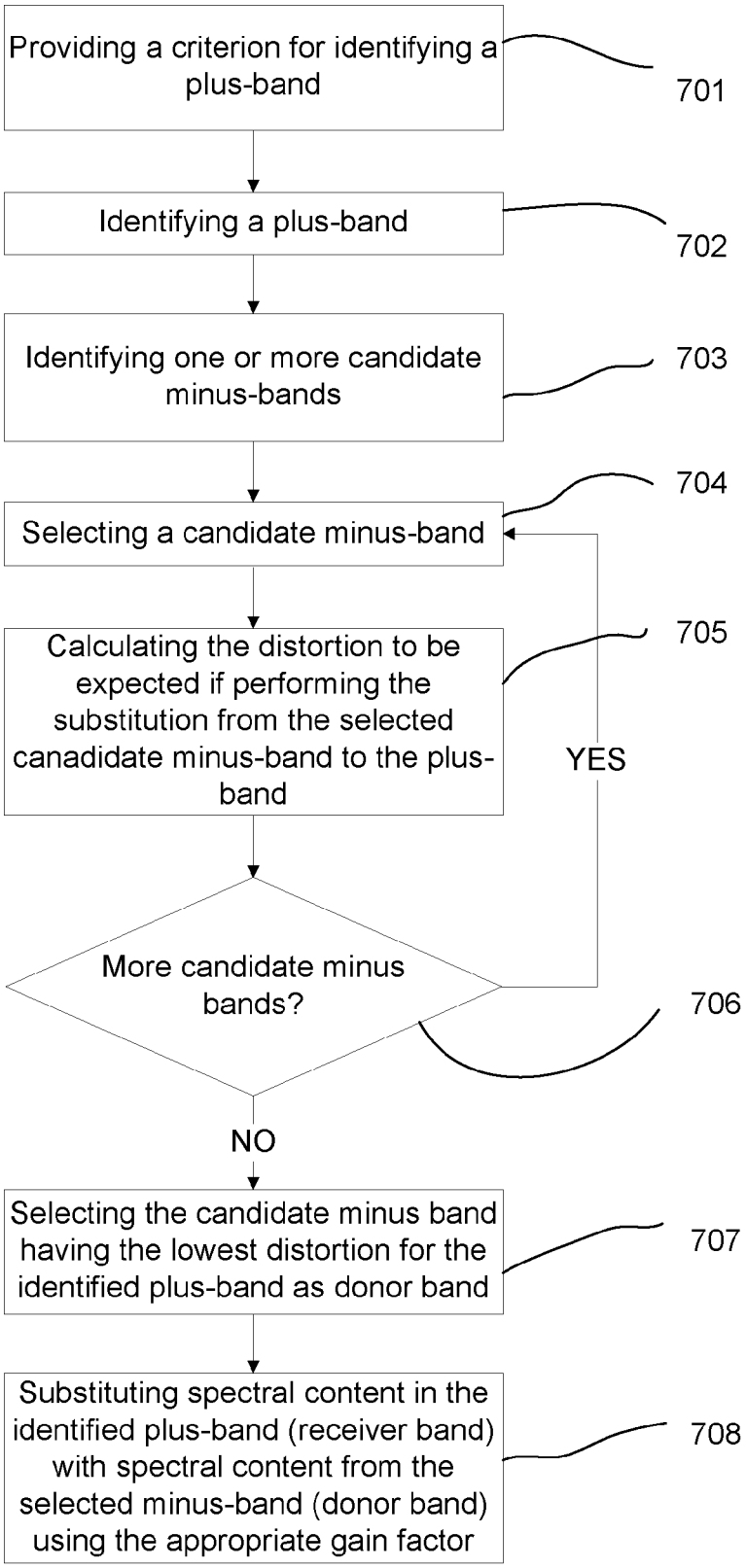
FIG. 7 shows a flowchart for a method of selecting a donor band for a particular receiver band according to an embodiment of the present invention.

FIG. 7 shows a flowchart for a method of selecting a minus-band for a particular plus-band according to an embodiment of the present invention.

The method comprises the following steps (701-708):

701 Providing a criterion for identifying a plus-band;

702 Identifying a plus-band;

703 Identifying one or more candidate minus-bands;

704 Selecting a candidate minus-band;

705 Calculating the distortion to be expected if performing the substitution from the selected candidate minus-band to the plus-band;

706 More candidate minus bands? If YES, go to step 704; if NO, go to step 707;

707 Selecting the candidate minus band having the lowest distortion for the identified plus-band as donor band; and

708 Substituting spectral content in the identified plus-band (receiver band) with spectral content from the selected minus-band (donor band) using the appropriate gain factor.

In an embodiment, at least some of the steps 701, 702, 703, 704, 705, 706, 707 and 708 such as a majority of the steps, e.g. all of the steps, are fully of partially implemented as software algorithms for running on a processor of a listening device.

In an embodiment, a criterion for identifying a minus-band is the complementary of the criterion for identifying a plus-band (i.e. 'minus-band=NOT plus-band'). In an embodiment, a separate criterion for identifying a minus-band is furthermore provided. In an embodiment, the distortion for each of the identified minus-bands is determined and the one having the lowest distortion is chosen as a donor band and its spectral content copied (and scaled with the corresponding gain factors) to the identified receiver band (the plus-band).

The invention is defined by the features of the independent claim(s). Preferred embodiments are defined in the dependent claims. Any reference numerals in the claims are intended to be non-limiting for their scope.

Some preferred embodiments have been shown in the foregoing, but it should be stressed that the invention is not limited to these, but may be embodied in other ways within the subject-matter defined in the following claims.

REFERENCES

WO 2007/112777 (WIDEX) Oct. 11, 2007
WO 94/09604 (GN DANAVOX) Apr. 28, 1994
WO 2007/006658 A1 (OTICON) Jan. 18, 2007
EP 1367566 (CODING TECHNOLOGIES) Dec. 3, 2003
US 2007/0269068 A1 (SIEMENS AUDIOLOGISCHE TECHNIK) Nov. 22, 2007
WO 2008/151970 A1 (OTICON) Dec. 18, 2008

[Hastl et al., 2007] H Hastl, E. Zwicker, Psychoacoustics, Facts and Models, 3rd edition, Springer, 2007, ISBN 10 3-540-23159-5

[Van de Par et al., 2008] Van de Par et al., "A new perceptual model for audio coding based on spectro-temporal masking", Proceedings of the Audio Engineering Society 124th Convention, Amsterdam, The Netherlands, May 2008.

[Hellgren, 2000] Johan Hellgren, Compensation for hearing loss and cancellation of acoustic feedback in digital hearing aids, PhD thesis, Linköping Studies in Science and Technology, Dissertations, No. 628, Linköping University, Sweden, 2000.

The invention claimed is:

1. A listening device for processing an input sound to an output sound, the listening device, comprising:

an input transducer for converting an input sound to an electric input signal;

an output transducer for converting a processed electric output signal to an output sound; and a forward path defined between the input transducer and the output transducer and comprising a signal processing unit for processing an input signal in a number of frequency bands, an SBS unit for performing spectral band substitution from one frequency band to another and providing an SBS-processed output signal, and an LG-estimator unit for estimating loop gain in each frequency band thereby identifying plus-bands according to a plus-criterion and minus-bands according to a minus-criterion, wherein based on an input from the LG-estimator unit, the SBS unit is adapted for substituting spectral content in a receiver band of the input signal with spectral content from a donor band in such a way that spectral content of the donor band is copied and inserted in the receiver band instead of its original spectral content, wherein the receiver band is a plus-band and the donor band is a minus-band, and the SBS unit is further configured to select the donor band based on a model of the human auditory system to provide minimum distortion, and a condition for selecting a frequency band $FB_i$ as plus band is that for that band $MAG(H_{cl}(FB_i))$ is larger than $1.3 \cdot MAG(FG(FB_i))$.

2. A listening device according to claim 1, wherein the model of the human auditory system is customized to a specific intended user of the listening device.

3. A listening device according to any of claim 1 or 2, wherein the SBS unit is configured to select the donor band from the input signal from a second input transducer.

4. A listening device according to claim 1, wherein the spectral content of the receiver band is equal to the spectral content of the donor band times a scaling factor, and the scaling factor provides that the magnitude of the signal in the receiver band after substitution is substantially equal to the magnitude of the signal in the receiver band before substitution.

5. A listening device according to claim 4, further comprising:

a memory wherein predefined scaling factors $G_{ij}$ for scaling spectral content from donor band i to receiver band j are stored.

6. A listening device according to claim 5, wherein the listening device is configured to update the predefined scaling factors $G_{ij}$ stored in the memory and distortion factors $D_{ij}$, defining an expected distortion when substituting spectral content from donor band i to a receiver band j, over time.

7. A listening device according to claim 5, wherein the scaling and distortion factors in addition to or as an alternative to the stored values of gain and distortion by substituting spectral content from a donor to a receiver band are functions of one or more measurable features of the donor band.

8. A listening device according to claim 1 further comprising a feedback loop from the output side to the input side of the forward path and comprising an adaptive FBC filter comprising a variable filter part for providing a specific transfer function and an update algorithm part for updating the transfer function of the variable filter part, the update algorithm part receiving first and second update algorithm input signals from the input and output side of the forward path, respectively.

9. A listening device according to claim 8 wherein the second update algorithm input signal is equal to or based on the SBS-processed output signal.

10. A listening device according to claim 1, configured to provide that a condition for selecting a frequency band as plus band is that the magnitude of loop gain MAG(LG) is larger than a plus-level.

11. A listening device according to claim 1 adapted to provide that a condition for selecting a frequency band as minus band is that the band has an estimated loop gain in that band smaller than a minus-level.

12. A listening device according to claim 11 wherein the plus-level is equal to the minus-level.

13. A listening device according to claim 1, wherein the SBS unit is configured to select the donor band based on a predefined algorithm comprising a distortion measure indicating an experienced distortion by moving spectral content from a particular donor band to a particular receiver band.

14. A listening device according to claim 5, wherein the gain values $G_{ij}$ and/or distortion factors $D_{ij}$ are determined for a number of sets of audio data of different type, said gain values $G_{ij}$ and/or distortion factors $D_{ij}$ for each type of audio data being separately stored in said memory.

15. A listening device according to claim 14 configured to analyse an input signal and determine its type, and to select an appropriate one of the gain $G_{ij}$- and/or distortion $D_{ij}$-factors to be used in the spectral substitution process.

16. A listening device according to claim 7, wherein a number of gain factors $G_{ij}(l,p)$ and/or distortion factors $D_{ij}(l,p)$ for a given band substitution $i \rightarrow j$ are stored in said memory as a function of donor band feature values, energy level l, and spectral peakiness p, and the listening device is configured to determine the resulting distortion for each donor band by consulting the stored $D_{ij}(l,p)$ values and to select the donor band leading to the lowest expected distortion and to use the gain value needed to obtain this distortion by looking-up the stored $G_{ij}(l,p)$ values.

17. A listening device according to claim 1, wherein the model of the human auditory system is a masking model.

18. A listening device according to claim 3, wherein the second input transducer is included in a contra-lateral listening device.

19. A listening device according to claim 7, wherein the one or more measureable features of the donor band include sound pressure level, spectral peakiness, and gain margin.

20. A listening device, comprising:

an input transducer for converting an input sound to an electric input signal;

an output transducer for converting a processed electric output signal to an output sound; and a forward path defined between the input transducer and the output transducer and including a signal processing unit for processing an input signal in a number of frequency bands, an SBS unit for performing spectral band substitution from one frequency band to another and providing an SBS-processed output signal, and an LG-estimator unit for estimating loop gain in each frequency band thereby identifying plus-bands according to a plus-criterion and minus-bands according to a minus-criterion, wherein based on an input from the LG-estimator unit, the SBS unit is adapted for substituting spectral content in a receiver band of the input signal with spectral content from a donor band in such a way that spectral content of the donor band is copied and inserted in the receiver band instead of its original spectral content, the receiver band is a plus-band and the donor band is a minus-band, the SBS unit is further configured to select the donor band based on a model of the human auditory system to provide minimum distortion, and a condition for selecting a frequency band as plus band is that the argument of LG is within a range of +/−10° around 0° or a multiple of $2\cdot\pi$ AND the magnitude of LG for the band in question is in a range between 0.8 and 1.

21. A listening device according to claim 1 or 20, further comprising:

a memory storing predefined distortion factors $D_{ij}$ defining an expected distortion when substituting spectral content from donor band i to a receiver band j.

22. A listening device according to claim 21 wherein for a given receiver band j, the donor band i having the lowest expected distortion factor $D_{ij}$ is selected for the substitution.

23. The listening device according to claim 1 or 20, wherein the SBS unit is further configured to scale the spectral content of the donor band with a scaling function.

24. A method of minimizing howl in a listening device, comprising converting an input sound to an electric input signal;

converting a processed electric output signal to an output sound;

defining an electric forward path of the listening device from the electric input signal to the processed electric output signal;

providing processing of an input signal in a number of frequency bands;

estimating loop gain in each frequency band, thereby identifying plus-bands having an estimated loop gain according to a plus criterion and minus-bands having an estimated loop gain according to a minus-criterion;

substituting spectral content in a receiver band of the input signal with spectral content from a donor band based on estimated loop gain in such a way that spectral content of the donor band is copied and inserted in the receiver band, wherein the selection of the donor band is based on a model of a human auditory system to provide minimum distortion;

providing a processed electric output signal; and providing that the receiver band is a plus-band and the donor band is a minus-band, wherein a condition for selecting a frequency band $FB_i$ as plus band is that for that band $MAG(H_{cl}(FB_i))$ is larger than $1.3\cdot MAG(FG(FB_i))$.

25. A method according to claim 24, further comprising:

providing that gain values, $G_{ij}$, representing scaling factors to be multiplied onto the spectral content from donor band i when copied to receiver band j have—in an off-line procedure—been stored in a memory accessible by the listening device.

26. A method according to claim 24 or 25, further comprising:

providing that distortion values, $D_{ij}$, representing the distortion to be expected when performing the substitution from band i to band j have—in an off-line procedure—been stored in memory accessible by the listening device.

27. The method according to claim 24, wherein the substituting further comprises scaling the spectral content of the donor band with a scaling function.

* * * * *